US012492047B2

(12) United States Patent
Parikh et al.

(10) Patent No.: US 12,492,047 B2
(45) Date of Patent: Dec. 9, 2025

(54) TAMPER RESISTANT CONTAINER

(71) Applicant: Polarpak Company, Brampton (CA)

(72) Inventors: Samir R. Parikh, Brampton (CA); Tajinder Singh, Brampton (CA); Jaskaran Singh Sukhija, Brampton (CA)

(73) Assignee: Polarpak Company, Brampton (CA)

( * ) Notice: Subject to any disclaimer, the term of this patent is extended or adjusted under 35 U.S.C. 154(b) by 0 days.

(21) Appl. No.: 18/029,009

(22) PCT Filed: Dec. 21, 2021

(86) PCT No.: PCT/CA2021/051854

§ 371 (c)(1),
(2) Date: Mar. 28, 2023

(87) PCT Pub. No.: WO2022/133591

PCT Pub. Date: Jun. 30, 2022

(65) Prior Publication Data

US 2023/0356889 A1 Nov. 9, 2023

Related U.S. Application Data

(60) Provisional application No. 63/129,117, filed on Dec. 22, 2020.

(51) Int. Cl.
*B65D 43/02* (2006.01)
*B65D 43/16* (2006.01)

(52) U.S. Cl.
CPC ..... *B65D 43/0254* (2013.01); *B65D 43/0239* (2013.01); *B65D 43/162* (2013.01); (Continued)

(58) Field of Classification Search
CPC ..... B65D 2401/60; B65D 2401/10; B65D 2401/15; B65D 43/162; (Continued)

(56) References Cited

U.S. PATENT DOCUMENTS 4,098,453 A 7/1978 Arneson
6,786,329 B2 9/2004 Onishi
(Continued)

FOREIGN PATENT DOCUMENTS

CA 2772192 A1 9/2012
CA 3196760 A1 6/2022
(Continued)

OTHER PUBLICATIONS

International Search Report and Written Opinion of PCT Application No. PCT/CA2021/051854, mail date Mar. 29, 2022, 9 pages.
(Continued)

*Primary Examiner* — James N Smalley
(74) *Attorney, Agent, or Firm* — Nelson Mullins Riley & Scarborough LLP

(57) ABSTRACT

A vacuum formed, tamper resistant container resists deformation of the sides thereof that might otherwise permit access to contents of the container without removal of the lid. Downward protruding lid features reinforce the wall of the container base, and buttress features included in the rim of the base extend from a base flange diagonally downward and inward to the inner rim of a recessed shelf, thereby resisting downward rotation of the wall beneath the lid protruding features. In embodiments, attachment tabs surrounded by frangible boundaries are incorporated in the lid and attached to the base by living hinges, such that removal of the lid requires breaking of the frangible boundaries and detachment of the lid from the attachment tabs. Pucker elements associated with the attachment tabs can cause the attachment tabs to pivot away from the lid when the attachment tabs are detached from the lid.

7 Claims, 17 Drawing Sheets

(52) U.S. Cl.
CPC ..... *B65D 2401/60* (2020.05); *B65D 2543/00101* (2013.01); *B65D 2543/00203* (2013.01); *B65D 2543/00842* (2013.01)

(58) Field of Classification Search
CPC ..... B65D 2543/00296; B65D 43/0254; B65D 43/0239; B65D 2543/00101; B65D 2543/00203; B65D 2543/00842
See application file for complete search history.

(56) References Cited

U.S. PATENT DOCUMENTS

| | | | | |
|---|---|---|---|---|
| 7,163,127 | B2 | 1/2007 | Seelhofer | |
| 7,918,357 | B2 | 4/2011 | Jaeb | |
| 8,272,526 | B1 | 9/2012 | Vovan et al. | |
| 8,807,385 | B1 | 8/2014 | Fosse | |
| 9,278,786 | B2 | 3/2016 | Vovan et al. | |
| 9,493,277 | B2 | 11/2016 | Parikh et al. | |
| 9,546,018 | B1 | 1/2017 | Vovan et al. | |
| 9,643,761 | B1 | 5/2017 | Guirguis et al. | |
| 9,944,436 | B2 | 4/2018 | Kalmanides | |
| 9,950,845 | B2 * | 4/2018 | Hsieh | B65D 55/024 |
| 10,384,843 | B2 | 8/2019 | Vovan et al. | |
| 10,723,524 | B2 | 7/2020 | Schoen et al. | |
| 11,077,991 | B2 | 8/2021 | Smith et al. | |
| 11,505,373 | B2 * | 11/2022 | Jackson | B65D 43/164 |
| 11,535,428 | B2 | 12/2022 | McCumber | |
| 2003/0183540 | A1 * | 10/2003 | Onishi | B65D 43/168 206/205 |
| 2007/0045317 | A1 | 3/2007 | Rosender et al. | |
| 2009/0206082 | A1 | 8/2009 | Vovan | |
| 2010/0072217 | A1 | 3/2010 | Parikh et al. | |
| 2010/0102074 | A1 * | 4/2010 | Parikh | B65D 41/32 220/810 |
| 2010/0224630 | A1 | 9/2010 | Petlak et al. | |
| 2011/0000929 | A1 | 1/2011 | Brown et al. | |
| 2012/0103990 | A1 | 5/2012 | McCumber | |
| 2012/0292322 | A1 | 11/2012 | Meyer et al. | |
| 2013/0068654 | A1 | 3/2013 | MacDonald | |
| 2015/0028033 | A1 | 1/2015 | Samuel | |
| 2015/0083725 | A1 | 3/2015 | Sinha et al. | |
| 2015/0175315 | A1 | 6/2015 | Parikh et al. | |
| 2017/0107031 | A1 | 4/2017 | Hsieh | |
| 2017/0158396 | A1 | 6/2017 | Guirguis et al. | |
| 2017/0158397 | A1 | 6/2017 | Guirguis et al. | |
| 2018/0093800 | A1 | 4/2018 | Fosse | |
| 2018/0215517 | A1 | 8/2018 | Vovan et al. | |
| 2019/0112110 | A1 | 4/2019 | Taylor | |
| 2019/0185221 | A1 * | 6/2019 | Allers | B65D 43/0249 |
| 2020/0331674 | A1 * | 10/2020 | Murphy | B65D 43/0272 |
| 2021/0107707 | A1 | 4/2021 | Lotfi et al. | |
| 2021/0139206 | A1 * | 5/2021 | Wang | B65D 55/024 |
| 2022/0219866 | A1 | 7/2022 | Yang et al. | |
| 2022/0250808 | A1 | 8/2022 | Hsieh | |
| 2023/0010372 | A1 | 1/2023 | Wang | |
| 2023/0017604 | A1 | 1/2023 | Parikh et al. | |
| 2023/0067459 | A1 | 3/2023 | Guirguis | |
| 2023/0159233 | A1 | 5/2023 | Hasegawa | |
| 2023/0356889 | A1 | 11/2023 | Parikh et al. | |

FOREIGN PATENT DOCUMENTS

| | | | |
|---|---|---|---|
| CA | 3226088 | A1 | 1/2023 |
| CN | 209973209 | U | 1/2020 |
| EP | 3231726 | B1 | 4/2020 |
| GB | 2616737 | A | 9/2023 |
| JP | 2015182781 | A | 10/2015 |
| WO | 2020105280 | A1 | 5/2020 |
| WO | 2022133591 | A1 | 6/2022 |
| WO | 2023/287529 | A1 | 1/2023 |

OTHER PUBLICATIONS

Intonational Search Report and Written Opinion for PCT Appl. No. PCT/US2022/033016 mail date Sep. 23, 2022, 7 pages.
International Preliminary Report on Patentability for PCT/US2022/033016 issued Jan. 16, 2024, 5 pages.
International Preliminary Report on Patentability for PCT/CA2021/051854 issued Jun. 13, 2024, 6 pages.
Extended European Search Report issued in European Patent Application No. 22842625.0, dated May 20, 2025, 7 pages.
Combined Search and Examination Report issued in United Kingdom Patent Application No. 2304695.6, issued Jun. 12, 2025, all enclosed pages cited.

* cited by examiner

TAMPER RESISTANT CONTAINER

RELATED APPLICATIONS

This application is a national phase application filed under 35 USC § 371 of PCT Application No. PCT/CA2021/051854 with an international filing date of Dec. 21, 2021. PCT Application No. PCT/CA2021/051854 claims the benefit of U.S. Provisional Application No. 63/129,117, filed Dec. 22, 2020. Both of these applications are incorporated by reference in their entirety for all purposes.

FIELD OF THE INVENTION

The invention relates to containers, and more particularly, to containers that inhibit unauthorized tampering with contents contained therein.

BACKGROUND OF THE INVENTION

Containers are used to store many types of items, such as foodstuffs, medicine, and numerous other types of packaged items. Generally, consumers of such items feel confident that the contents were properly prepared and handled before and during the original packaging. However, consumer concerns sometimes arise regarding any possibility that the contents may have been tampered with, or otherwise accessed, by an unauthorized party between the time when the package was originally sealed with the contents inside, and the time that the consumer opens the package to consume the contents.

One approach is to include one or more tamper-evident features as part of the container, such as a shrink wrap cover, locking closure, or seal that must be broken or otherwise visibly removed or altered before a lid of a container can be removed from the base of the container. Another approach is to provide a base and lid closure aspect that includes a unitary, built-in tear strip or frangible element that requires a user to destroy a part of the container to remove the lid from the base.

When a low-cost, disposable container is needed, it is often desirable to manufacture the container from a plastic sheet or web by vacuum forming. Typically, separate bases and lids are manufactured by vacuum forming processes, and then combined together after the contents are added to the container. Another approach is to manufacture the base and lid in a single vacuum forming step, wherein the lid is attached to the base by a living hinge that allows the lid to be easily closed after the contents are added.

To maintain the low cost of vacuum formed containers, it is often desirable to avoid additional manufacturing steps, such as applying a shrink wrap cover to the container. Instead, the interlocking aspects between the base and lid may include a frangible feature that is configured such that it is difficult to dislodge the lid from the container without breaking the frangible feature, and thereby providing evidence of tampering.

However, the walls of containers that are manufactured economically using vacuum forming are typically thin. While the walls of such a container will generally provide structural competence under normal circumstances of storage and transportation, they may be easy to deform by someone attempting to gain unauthorized access to the contents without dislodging the lid from the base, thereby circumventing any tamper-evident features. This problem is accentuated when a container includes long sides, whereby a side can be pushed inward and downward near its center so that a gap is formed between the side and the lid of the container.

What is needed, therefore, is vacuum formed container that inhibits deformation of sides thereof, and thereby inhibits access to its contents until the lid is removed from the base. Also needed is a tamper evident feature for a vacuum formed container that does not require additional manufacturing steps after the vacuum forming thereof.

SUMMARY OF THE INVENTION

The present invention is a vacuum formed container that inhibits deformation of sides thereof, and thereby inhibits access to its contents until the lid is removed from the base. Another general aspect of the invention is a tamper evident feature for a vacuum formed container that does not require additional manufacturing steps after the vacuum forming thereof.

More specifically, a first general aspect of the disclosed container includes a base having a bottom, at least one wall, and a base rim surrounding an upper edge of the base that is configured for interlocking with a corresponding lid rim of a compatible lid. The base rim includes a recessed shelf surrounded by a rim wall and a flange, and configured such that when the lid is installed on the base, protruding rim features included in the lid rim extend toward the recessed shelf below the flange and beside the rim wall, thereby reinforcing the sides of the base against lateral indentation thereof. In addition, the base rim includes novel features, referred to herein as "buttress" features, that reinforce the sides of the base against being rotated inward and downward, so that the rim of the base cannot be pushed below the protruding lid features.

The buttress features of the present invention are compatible with vacuum forming of the base of the container, and each buttress feature is formed as a lateral indentation of the rim wall and recessed shelf that is bounded on an upper side thereof by a downward sloping upper surface extending from the base flange to an inner rim of the recessed shelf. Because of this intrusion of the buttress features into the rim wall and recessed shelf of the base, corresponding gaps are provided between the protruding lid features.

Embodiments include only two opposing buttress features located on two opposing sides of the base, or only four buttress features, including one buttress feature on each of four sides. Still other embodiments include a plurality of buttress features on each of two opposing walls, for example if the container is long and narrow, while still other embodiments include a plurality of buttress features included on each side of the base. It will be understood that the scope of the present invention includes embodiments with any number of buttress features on any combination of sides of the base.

Embodiments of the present invention further include a tamper evident feature configured to indicate whether the lid has been removed from the base at any time after the original sealing thereof. In some of these embodiments, the tamper evident feature includes a frangible attachment of the lid to the base. In an exemplary embodiment, frangible attachment of the lid to the base is provided on only one "hinge" side of the container, and pull tabs are provided in the rim and base flanges proximal to the hinge side that facilitate grasping of the lid and base and breaking of the frangible attachment. In this exemplary embodiment, a lid flange that surrounds and is pressed against the base flange is thin and flat, and does not extend outward as far as the base flange, so that separation of the lid from the base without use of the pull tabs and breaking of the frangible attachment is rendered highly difficult.

In the exemplary embodiments, the lid is attached to the container by a plurality of attachment tabs that are included in the lid and are attached by living hinges to the base, wherein the attachment tabs are surrounded by frangible boundaries that enable them to be broken free of the lid, and to remain attached to the base, when the lid is removed. In some of these embodiments, lid protrusions are not continuous across the region of the attachment tabs. In these embodiments, when the container is resealed, it is ventilated due to openings in the lid that result from the breaking free and lifting up of the attachment tabs. This configuration can be advantageous, for example, when ventilation of fresh produce is required, or when release of steam from hot food is desirable.

In other embodiments, the lid protrusions are continuous across the attachment tabs. In these embodiments, the lid protrusions are diverted inward from the living hinge at least in the regions of the attachment tabs, so that they do not interfere with the operation of the attachment tabs, and so that the container will not be ventilated after it is resealed and the attachment tabs have been broken free.

In a second general aspect of the invention, the lid is attached to the container by a plurality of attachment tabs that are included in the lid as described above, and the living hinge attachments of at least some of the attachment tabs to the base include "pucker" elements that function in a manner similar to a leaf spring to create a spring tension that would tend to pivot the attachment tabs together with the lid away from the base, except that this spring tension is insufficient to overcome the frictional contact between the lid protrusion features and the rim wall of the base. However, when the attachment tabs are broken free from the lid, the attachment tabs are lifted up and away from the lid by the pucker elements, and the spring tension is relieved. The pucker elements together with the attachment tabs thereby provide an easily visible indication that the frangible attachment of the lid to the base has been broken, even after the lid is subsequently reinstalled onto the base.

One general aspect of the present invention is a tamper resistant container that includes a base having a substantially horizontal bottom joined at a perimeter thereof to a lower edge of at least one substantially vertical base wall, an upper edge of the at least one base wall terminating in a substantially horizontal shelf extending outward from the upper edge of the at least one base wall and terminating in a substantially vertical, upwardly extending rim wall, said rim wall terminating in an outwardly extending, substantially horizontal base flange, a lid surrounded by a substantially horizontal lid flange, the lid comprising a plurality of protruding lid features proximate and surrounded by the lid flange and extending downward from the lid flange, wherein the lid can be installed onto the base such that the lid flange rests on the base flange, and the protruding lid features extend downward along the rim wall of the base toward the shelf of the base, and at least one buttress feature, each of the buttress features being a horizontal indentation in the shelf and rim wall of the base, the indentation being bounded by an upper buttress wall that extends obliquely from the top of the rim wall to the top of the base wall.

In embodiments, upon first installation of the lid on the base, the protruding lid features form a substantially airtight seal between the lid and the base.

In any of the above embodiments, the base can comprise a plurality of sides, and each of the sides of the base can includes at least one of the buttress features.

In any of the above embodiments, the lid can be attached to a hinge edge of the base flange by at least one living hinge. In some of these embodiments, the lid attachment to the base is frangible.

Any of the above embodiments can further include at least one attachment tab attached by a living hinge to a hinge edge of the base flange, all of the attachment tabs being attached to the same hinge edge of the base flange, all of the attachment tabs being incorporated into the lid flange and being substantially co-planar with the lid flange, the attachment tabs being bounded by frangible tab boundaries that permit the attachment tabs to be broken free of the lid, whereupon the lid is freed from the base. In some of these embodiments, each of the attachment tabs is coordinate with a corresponding pucker element that is configured to apply a lifting force to the attachment tab, such that when the attachment tabs are broken free from the lid and the lid is subsequently re-installed on the base, the attachment tabs are caused by the pucker elements to extend upward out of the plane of the lid flange. And some of these embodiments further include a lid pull tab extending from the lid flange and a base pull tab extending from the base flange, the lid and base pull tabs being proximate each other but not fully overlapping when the lid is installed on the base, so that the lid and base pull tabs can be separately grasped and pulled apart from each other, thereby breaking the frangible tab boundaries of the attachment tabs and freeing the lid from the base.

In any of the above embodiments that includes at least one attachment tab attached by a living hinge to a hinge edge of the base flange, gaps between the protruding lid features can be provided in the regions of the attachment tabs so that the protruding lid features do not overlap the attachment tabs, and so that upon reattachment of the lid to the base, the container is ventilated due to openings in the lid resulting from the breaking free of the attachment tabs from the lid. Or, in the regions of the attachment tabs the protruding lid features can be located inward of the attachment tabs, so that the protruding lid features do not overlap the attachment tabs, and so that upon reattachment of the lid to the base, the container is not ventilated due to openings in the lid resulting from the breaking free of the attachment tabs from the lid. In some of these embodiments the protruding lid features are located inward from the attachment tabs and are substantially parallel with the hinge edge of the base flange. In other of these embodiments the protruding lid features are proximate the hinge edge of the base flange in regions between the attachment tabs, and are offset inward from the hinge edge of the base flange in regions proximate the attachment tabs, such that the protruding lid features do not overlap the attachment tabs.

In any of the above embodiments, the lid flange can be narrower than the base flange, such that the base flange extends horizontally outward further than the lid flange when the lid is installed on the base.

A second general aspect of the present invention is a tamper evident container that includes a base having a substantially horizontal bottom joined at a perimeter thereof to a lower edge of at least one substantially vertical base wall, the base comprising a substantially horizontal base flange extending outwardly from an upper rim of the base, a lid that can be installed onto the base such that a seal is formed between the lid and the base, the lid being surrounded by a lid flange, and at least one attachment tab attached by a living hinge to a living hinge side of an upper edge of the base, all of the attachment tabs being attached to the same living hinge side of the upper edge of the base, all of the attachment tabs being incorporated into and substantially co-planar with the lid flange, and being bounded by frangible tab boundaries that permit the attachment tabs to be broken free of the lid, thereby freeing the lid from the base, each of the attachment tabs being coordinate with a corresponding pucker element that is configured to apply a lifting force to the attachment tab, such that when the attachment tabs are broken free from the lid and the lid is subsequently re-installed on the base, the attachment tabs are caused by the pucker elements to extend upward away from the lid flange.

In embodiments, the at least one base wall includes a substantially horizontal shelf extending outward, the substantially horizontal shelf terminating in a substantially vertical, upwardly extending rim wall, said rim wall terminating in the outwardly extending, substantially horizontal base flange. In some of these embodiments the lid comprises a plurality of protruding lid features that extend downward from the lid, wherein when the lid is installed on the base the protruding lid features extend downward along the rim wall of the base toward the substantially horizontal shelf of the base. In some of these embodiments, gaps between the protruding lid features are provided in the regions of the attachment tabs so that the protruding lid features do not overlap the attachment tabs, and so that upon reattachment of the lid to the base, the container is ventilated due to openings in the lid resulting from the breaking free of the attachment tabs from the lid. In other of these embodiments, in regions proximate the attachment tabs the protruding lid features are located inward of the attachment tabs, so that the protruding lid features do not overlap the attachment tabs, and so that upon reattachment of the lid to the base, the container is not ventilated due to openings in the lid resulting from the breaking free of the attachment tabs from the lid. In some of these embodiments, the protruding lid features are located inward from the attachment tabs and are substantially parallel with the hinge edge of the base flange. In other of these embodiments, the protruding lid features are proximate the hinge edge of the base flange in regions between the attachment tabs, and are offset inward from the hinge edge of the base flange in regions proximate the attachment tabs, such that the protruding lid features do not overlap the attachment tabs.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is a vacuum formed container that inhibits deformation of sides thereof, and thereby inhibits access to its contents until the lid is removed from the base. Another general aspect of the invention is a tamper evident feature for a vacuum formed container that does not require additional manufacturing steps after the vacuum forming thereof.

Figure 1A:
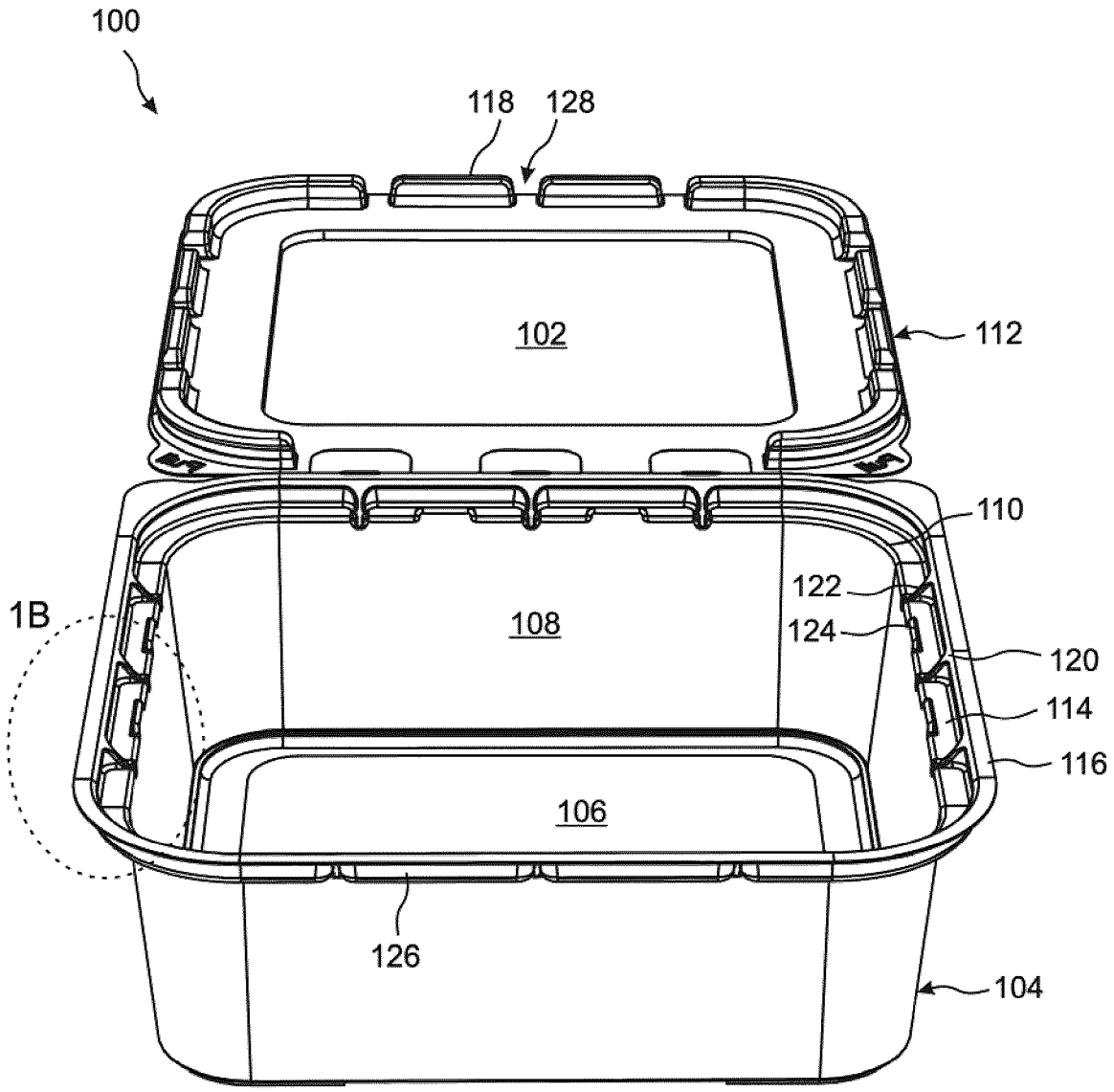
FIG. 1A is a perspective of an exemplary embodiment of the present invention, shown with the lid open prior to filling the container with contents.
Figure 1B:
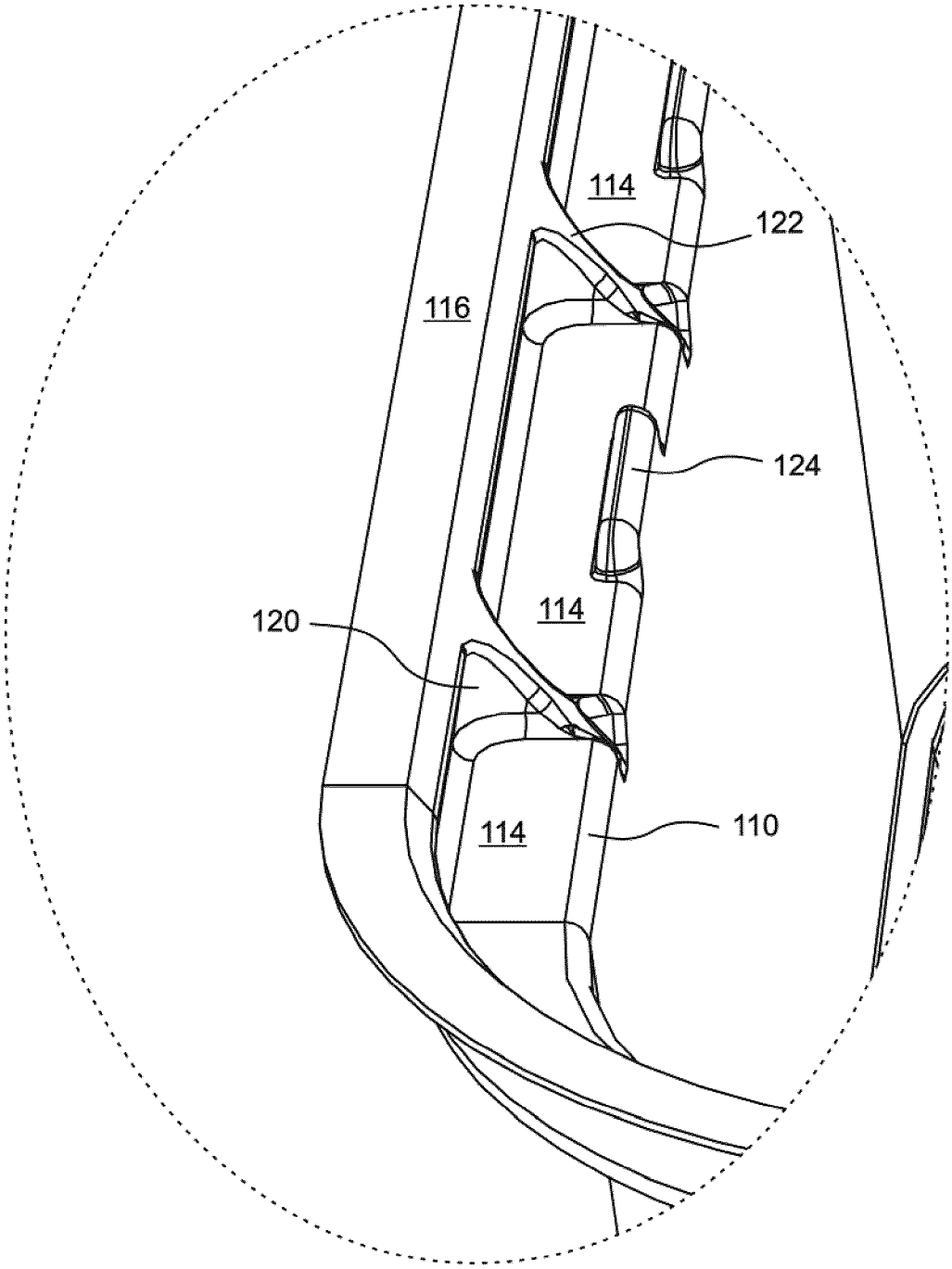
FIG. 1B is an enlarged perspective view of the rim of the base of the exemplary embodiment.

Regarding a first general aspect of the invention, with reference to FIGS. 1A and 1B, the disclosed container 100 includes a base 104 having a bottom 106, at least one wall 108, and a base rim 110 surrounding an upper edge of the wall 108 that is configured for interlocking with a corresponding lid rim 112 of a lid 102. The base rim 110 includes a substantially horizontal recessed shelf 114 surrounded by a substantially vertical rim wall 126 that terminates in a substantially horizontal, flat base flange 116. The base rim 110 is thereby configured such that when the lid 102 is installed on the base 104, protruding lid features 118 included in the lid rim 112 extend below the base flange 116 and beside the rim wall 126 toward the recessed shelf 114, thereby reinforcing the sides 108 of the base 104 against lateral indentation thereof. The embodiment of FIGS. 1A and 1B further includes base protrusions 124 that extend upward from an inner edge of the recessed shelf 114, such that the lid protrusions 118 extending downward from the lid 102 are inserted between the base protrusions 124 and the rim wall 126 of the base 104.

In addition, the rim 110 of the base 104 includes novel features, referred to herein as "buttress" features 120, that reinforce the sides 108 of the base 104 against being rotated inward and downward, so that the rim 110 of the base cannot be pushed below the protruding lid features 118 of the lid. The buttress features 120 are formed as lateral indentations of the rim wall 126 and recessed shelf 114, and are bounded on upper sides thereof by downward sloping upper surfaces 122 extending from the base flange 116 to the inner rim of the recessed shelf 114. Because of this intrusion of the buttress features 120 into the rim 110 of the base 104, corresponding gaps 128 are provided between the protruding lid features 118.

Embodiments include only two opposing buttress features 120 located on two opposing sides 108 of the base 104, or only four buttress features 120, including one buttress feature 120 on each of four sides 108. Still other embodiments include a plurality of buttress features 120 on each of two opposing walls 108, for example if the container 100 is long and narrow. The embodiment of FIG. 1 includes a plurality of buttress features 120 included on each side 108 of the base 104. It will be understood that the scope of the present invention includes embodiments with any number of buttress features 120 on any combination of sides 108 of the base.

Figure 2:
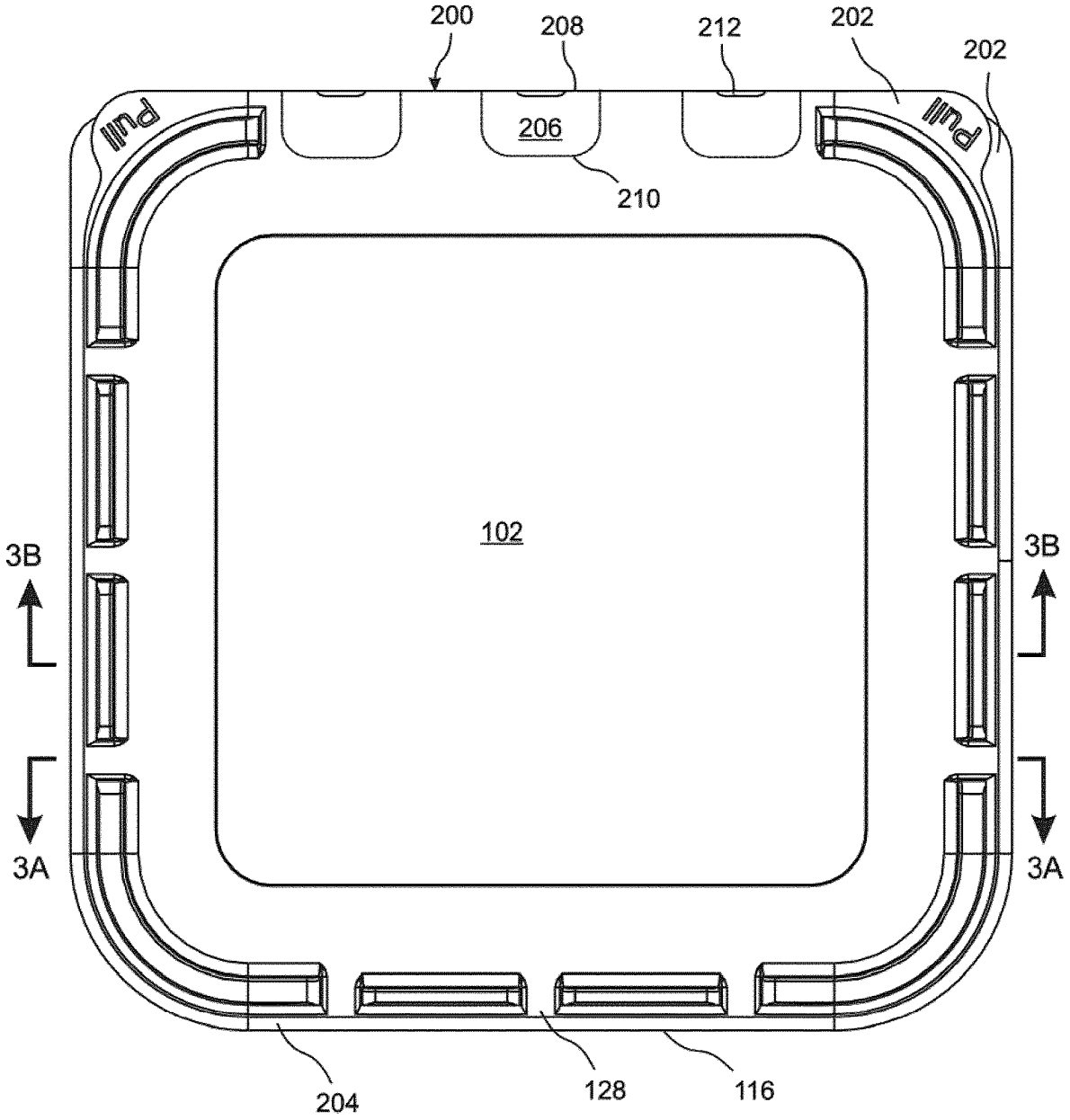
FIG. 2 is a top view of the exemplary embodiment, shown after the container has been filled and the lid has been attached to the base.
Figure 3A:
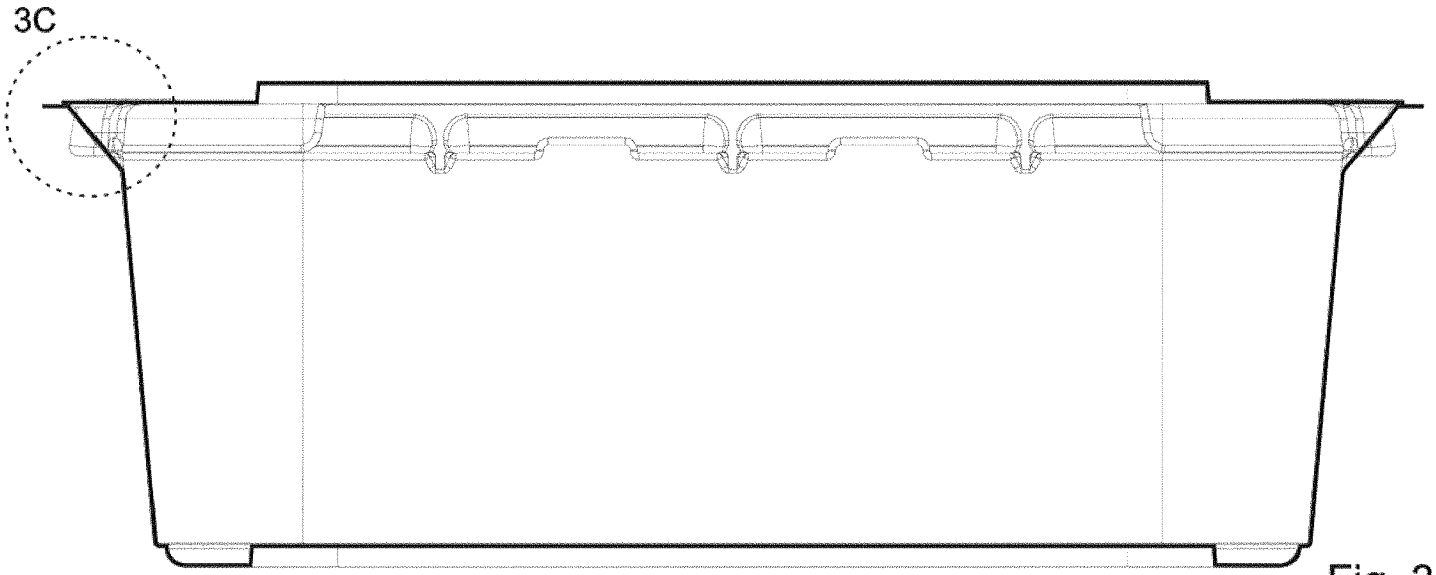
FIG. 3A is a sectional view from the side of the embodiment of FIG. 2, where the sectional cut has been made through a pair of opposing buttress features.
Figure 3B:
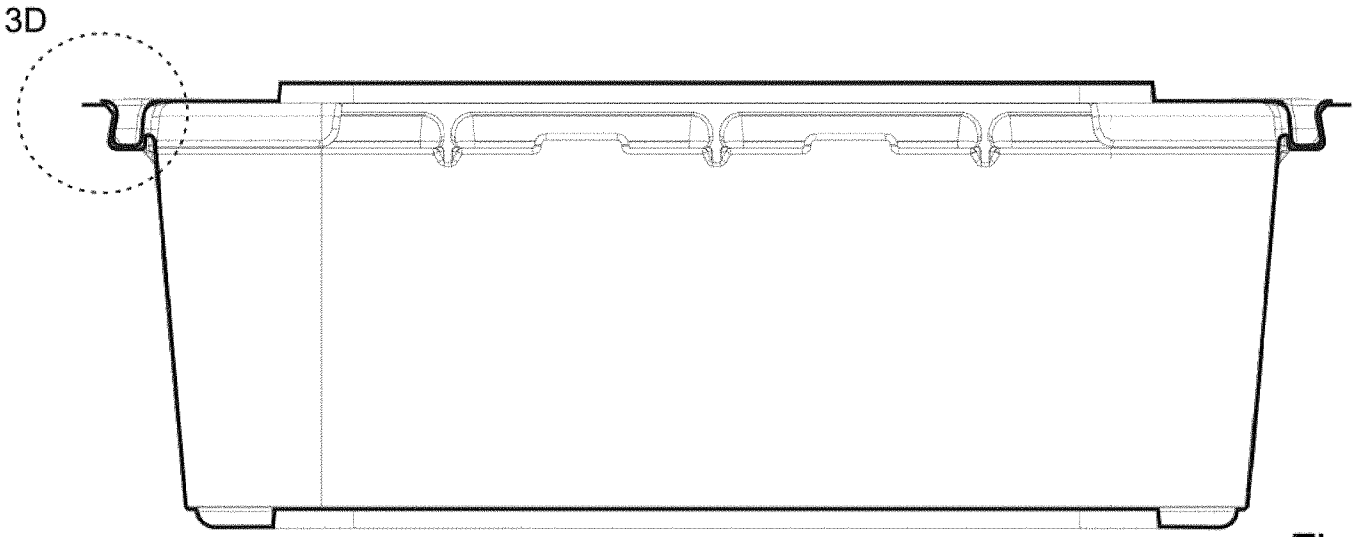
FIG. 3B is a sectional view from the side of the embodiment of FIG. 2, where the sectional cut has been made between the buttress features through a pair of opposing base protrusions.
Figure 3C:
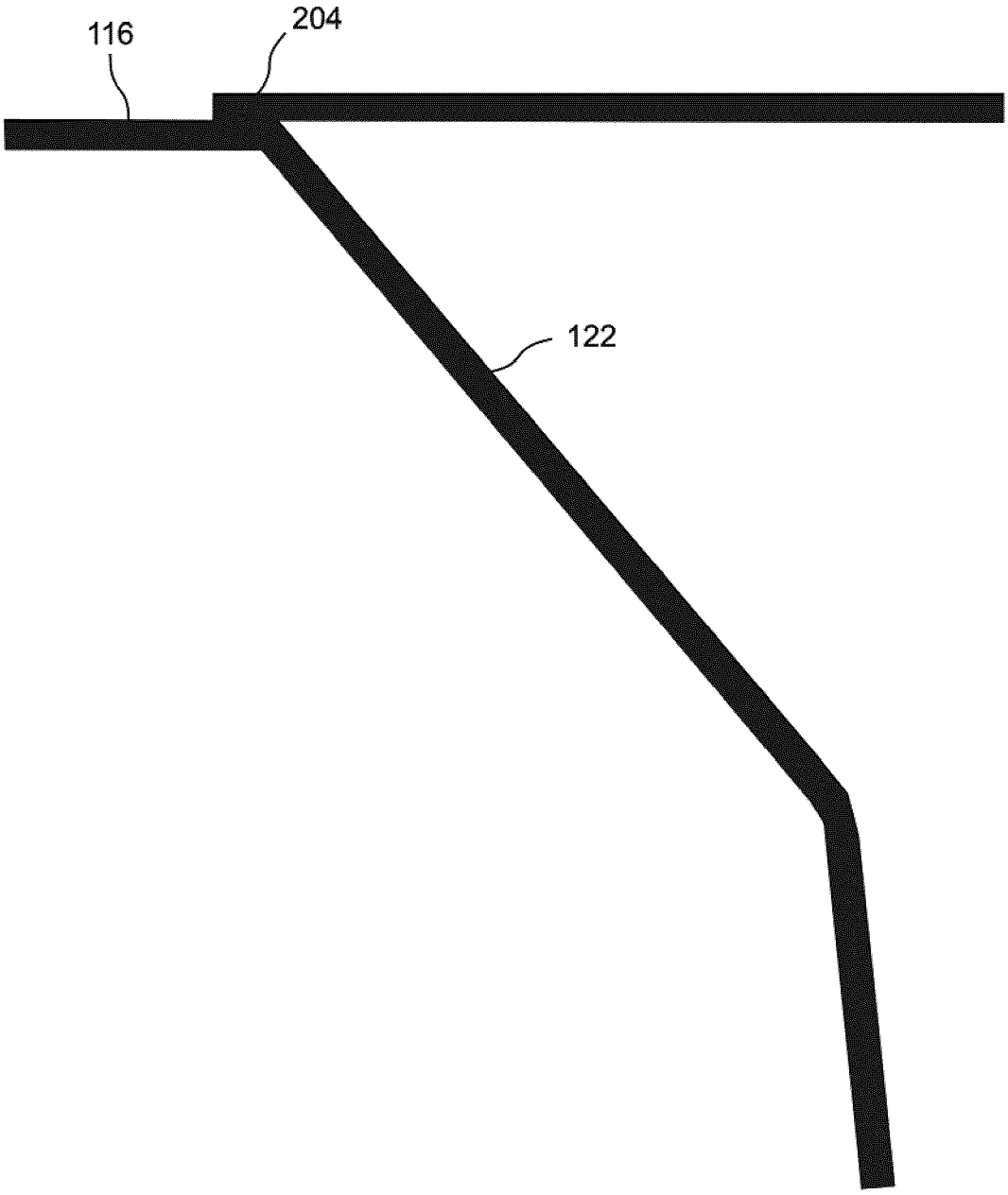
FIG. 3C is an enlarged view of a rim portion of the cut intersection of FIG. 3A.
Figure 3D:
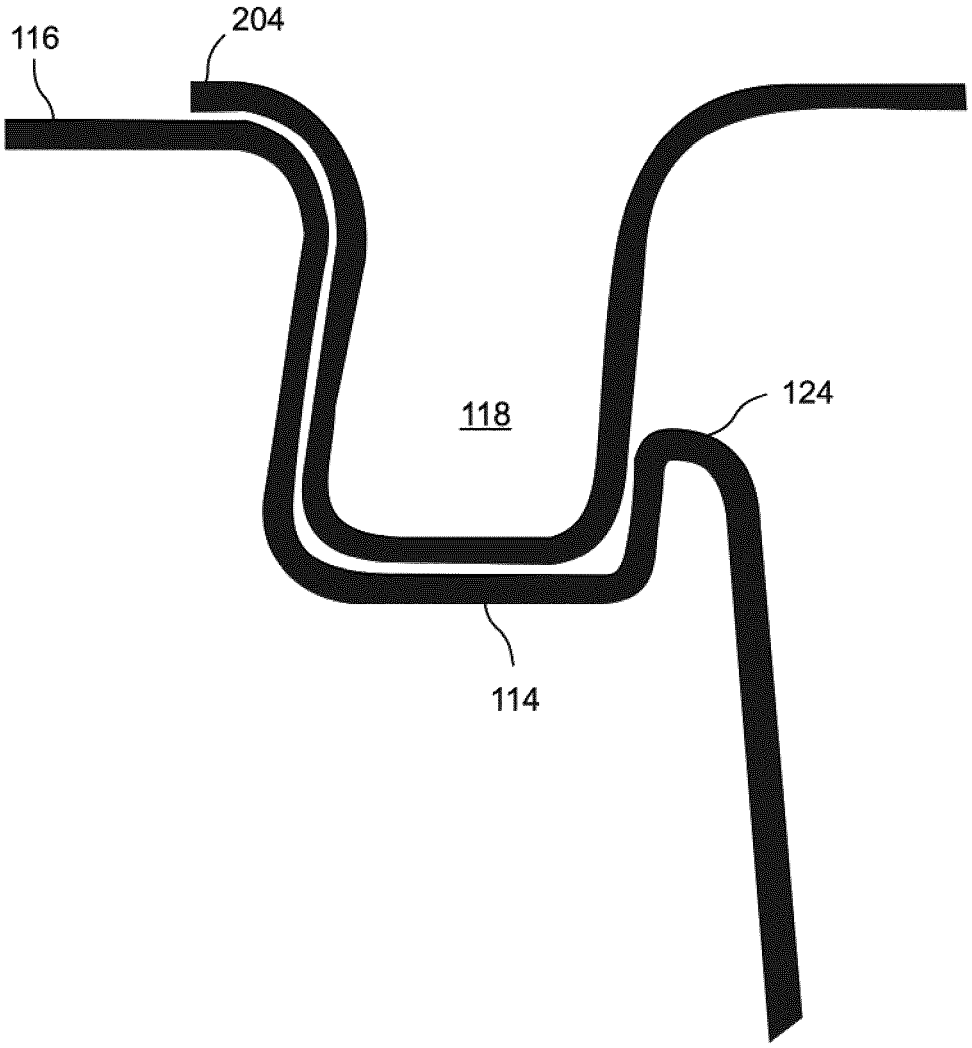
FIG. 3D is an enlarged view of a rim portion of the cut intersection of FIG. 3B.

FIGS. 3A and 3B present sectional views of the exemplary embodiment of FIGS. 1A-2, taken as indicated in FIG. 2, wherein the cross section of FIG. 3A is taken through a pair of opposing the buttress elements 120, while the cross section of FIG. 3B is taken in between the buttress elements 120. FIGS. 3C and 3D are close-up cross-sectional views of the rims 110 of FIGS. 3A and 3B, respectively.

Embodiments of the present invention further include at least one tamper evident feature configured to indicate whether the lid 102 has been removed from the base 104 at any time after the original sealing of the container 100. In some of these embodiments, the tamper evident feature includes a frangible attachment of the lid 102 to the base 104. With reference again to FIG. 2, in the exemplary embodiment frangible attachment 210 of the lid 102 to the base 104 is provided on only one "hinge" side of the container 100, and pull tabs 202 are provided proximal to the hinge side 200 in a lid flange 204 of the lid 102, and in the base flange 116. The pull tabs 202 facilitate grasping of the lid 102 and base 104 to pull them apart and break the frangible attachment 210 therebetween. In the illustrated exemplary embodiment, the lid flange 204 surrounds and is pressed against the base flange 116, is thin and flat, and does not extend outward as far as the base flange 116, such that separation of the lid 102 from the base 104 without use of the pull tabs 202 and breaking of the frangible attachment 210 is rendered highly difficult.

As can be seen in FIG. 2, the lid 102 includes a plurality of attachment tabs 206 that are included in the lid 102 and are attached by living hinges 208 to the base 104, wherein the attachment tabs 206 are surrounded by frangible boundaries 210 that enable them to be broken free of the lid 102, thereby freeing the lid 102 from the base 104 while the attachment tabs 206 remain attached to the base 104.

Figure 4:
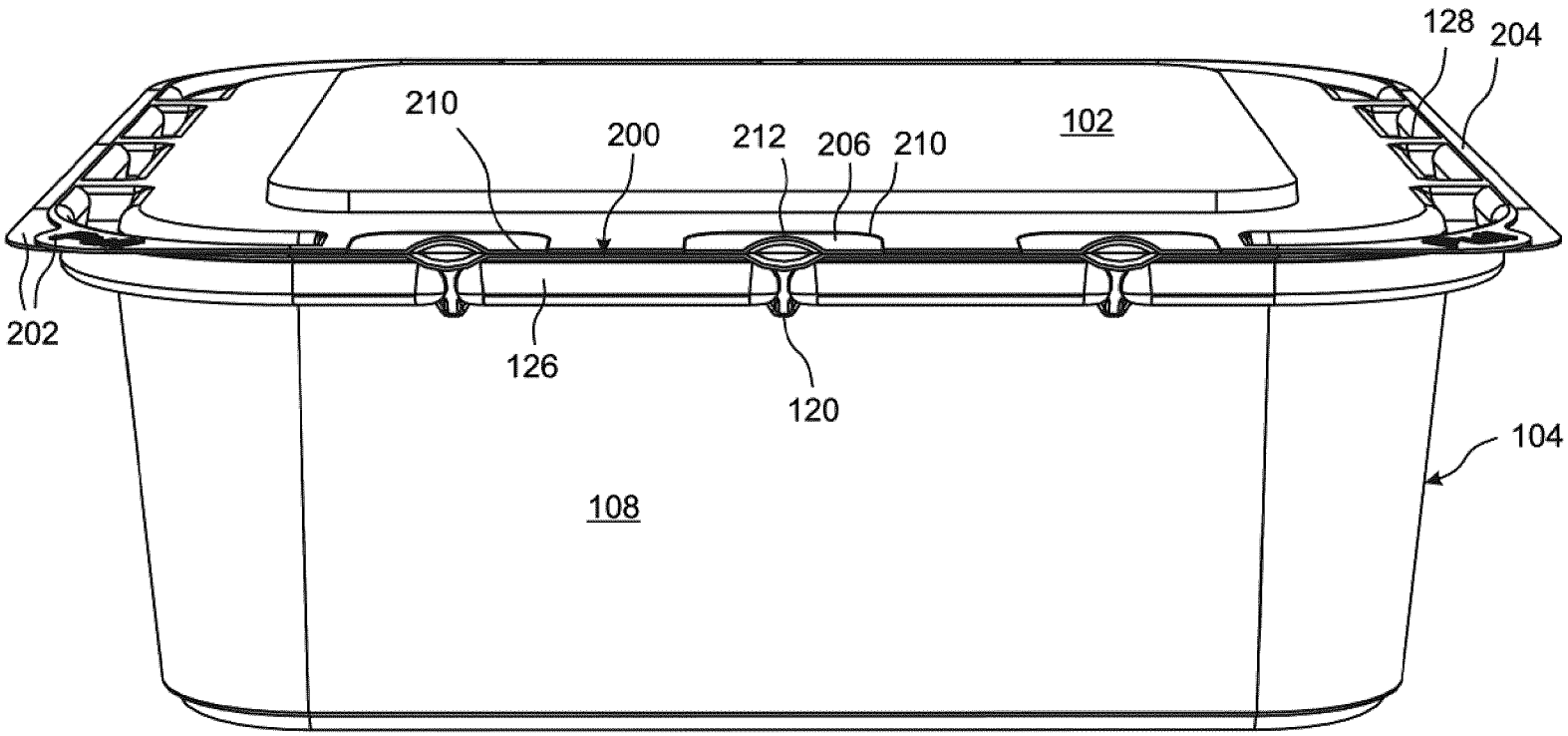
FIG. 4 is a perspective view of the embodiment of FIG. 2, directed to the side of the container that includes pucker elements.

According to a second general aspect of the present invention, with reference to FIG. 4, which is a perspective view of the exemplary embodiment directed toward the hinge side 200 of the container 100, at least some of the living hinges 208 that join the attachment tabs 206 to the base 104 include "pucker" elements 212 that function in a manner similar to a leaf spring, whereby when the attachment tabs 206 are attached to the lid 102 and the lid 102 is rotated about the living hinges 208 to close the container 100, a spring tension is created by the pucker elements 212 that would tend to pivot the lid back away from the base, except that there is not sufficient tension to overcome the friction between the lid protruding features 118 and the rim wall 126 of the base 104.

Figure 5:
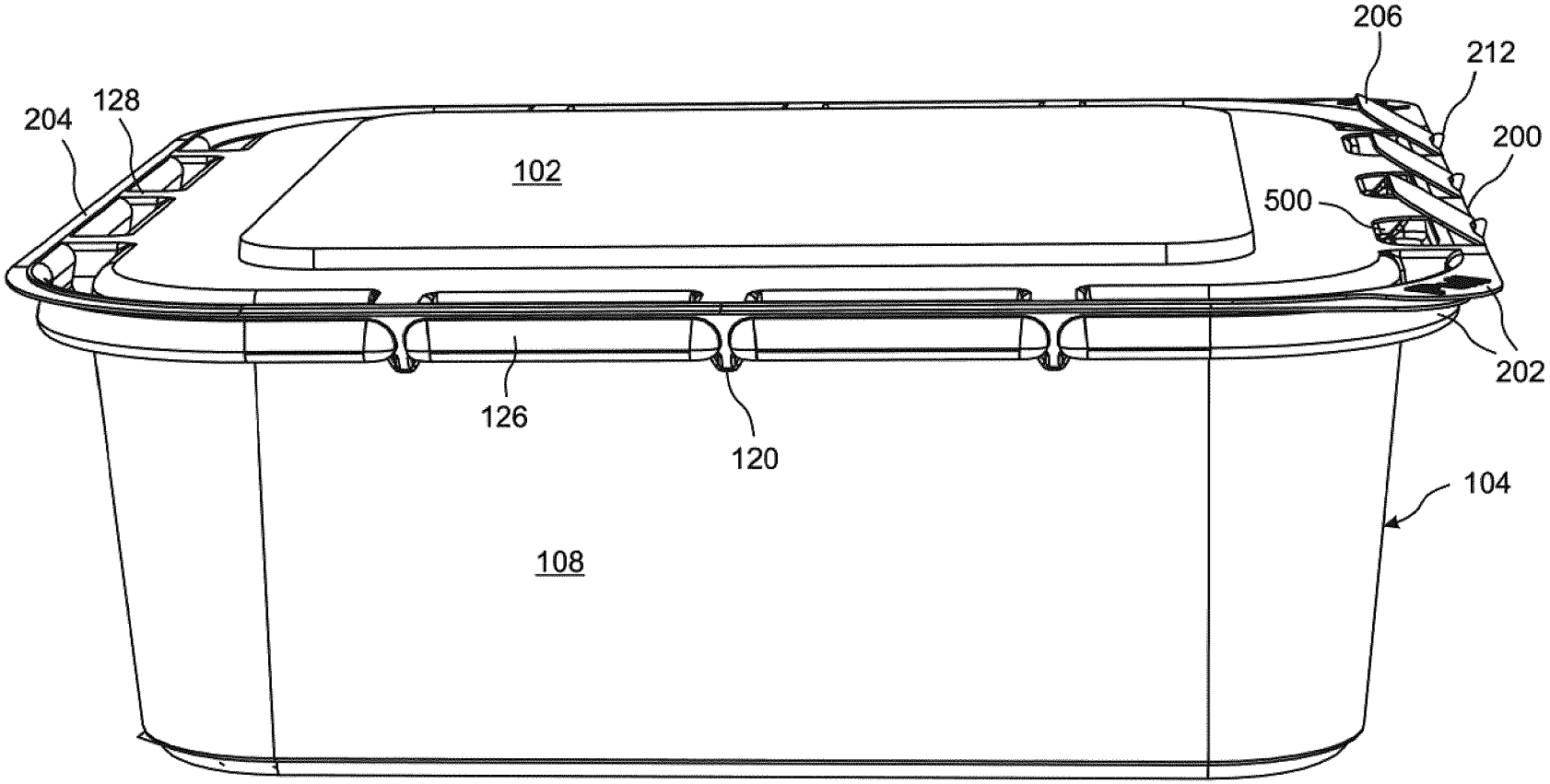
FIG. 5 is a perspective view of an embodiment of the present invention shown after the attachment tabs have been broken free of the lid, and the lid has been replaced on the base.

However, with reference to FIG. 5, when the attachment tabs are broken free from the lid, the attachment tabs 206 are lifted up and away from the lid 102 by the pucker elements 212, thereby relieving the spring tension. The pucker elements 212 together with the attachment tabs 206 thereby provide an easily visible indication that the frangible attachment of the lid 102 to the base 104 has been broken, by lifting the attachment tabs 206 upward out of the plane of the lid even after the lid 102 is reinstalled onto the base 104.

It should be noted that the attachment tabs and pucker features of the second general aspect of the invention can be combined with the first general aspect of the invention, as shown in the drawings, but can also be provided separately from the first general aspect, for example if the vacuum formed container omits one or more of the horizontal shelf 114, the vertical rim wall 126, and the protruding lid features 118 with or without gaps 128.

In the exemplary embodiment of FIGS. 1-5, the protruding lid features 118 are not continuous across the region of the attachment tabs 206. In these embodiments, when the container 100, is resealed, it is ventilated due to the openings 500 in the lid 102 that result from the breaking free and lifting up of the attachment tabs 206. This configuration can be advantageous, for example, when ventilation of fresh produce is required, or when release of steam from hot food is desirable.

In other embodiments the protruding lid features 118 are continuous across the attachment tabs 206. In these embodiments, the protruding lid features 118 are diverted inward from the living hinge 208, at least in the regions of the attachment tabs 206, so that they do not interfere with the operation of the attachment tabs 206, and so that the container will not be ventilated after it is resealed and the attachment tabs 206 have been broken free of the lid.

Figure 6A:
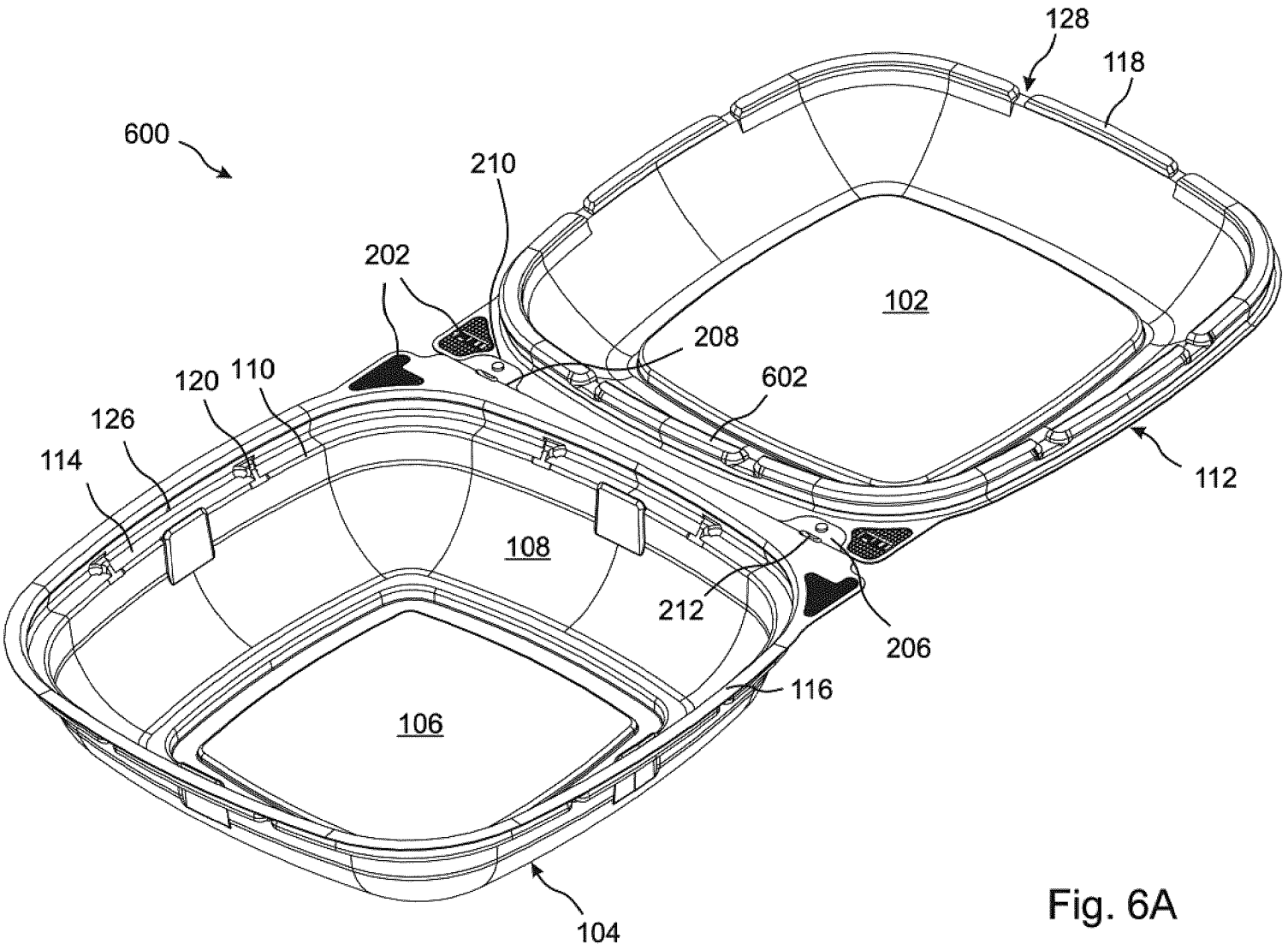
FIG. 6A is a perspective view of an embodiment wherein the lid protruding features are offset from the attachment tabs along the entire hinge side of the container, the embodiment being shown before initial filling of the container.

FIG. 6A illustrates an embodiment 600 in which the protruding lid features 118 avoid overlap with the attachment tabs 206 by being offset away from the living hinge 208 along the entire length 602 of the living hinge 208. FIG. 7 illustrates another embodiment 700 in which the protruding lid features 118 avoid overlap with the attachment tabs 206 by being offset away from the living hinge 208 only in the regions 702 of the attachment tabs 206. In this embodiment, the attachment tabs 206 are more rounded than in FIGS. 1-6, so as to better accommodate the shaping of the protruding lid features 118. Otherwise, they function in an identical manner to the previously described embodiments.

Figure 6B:
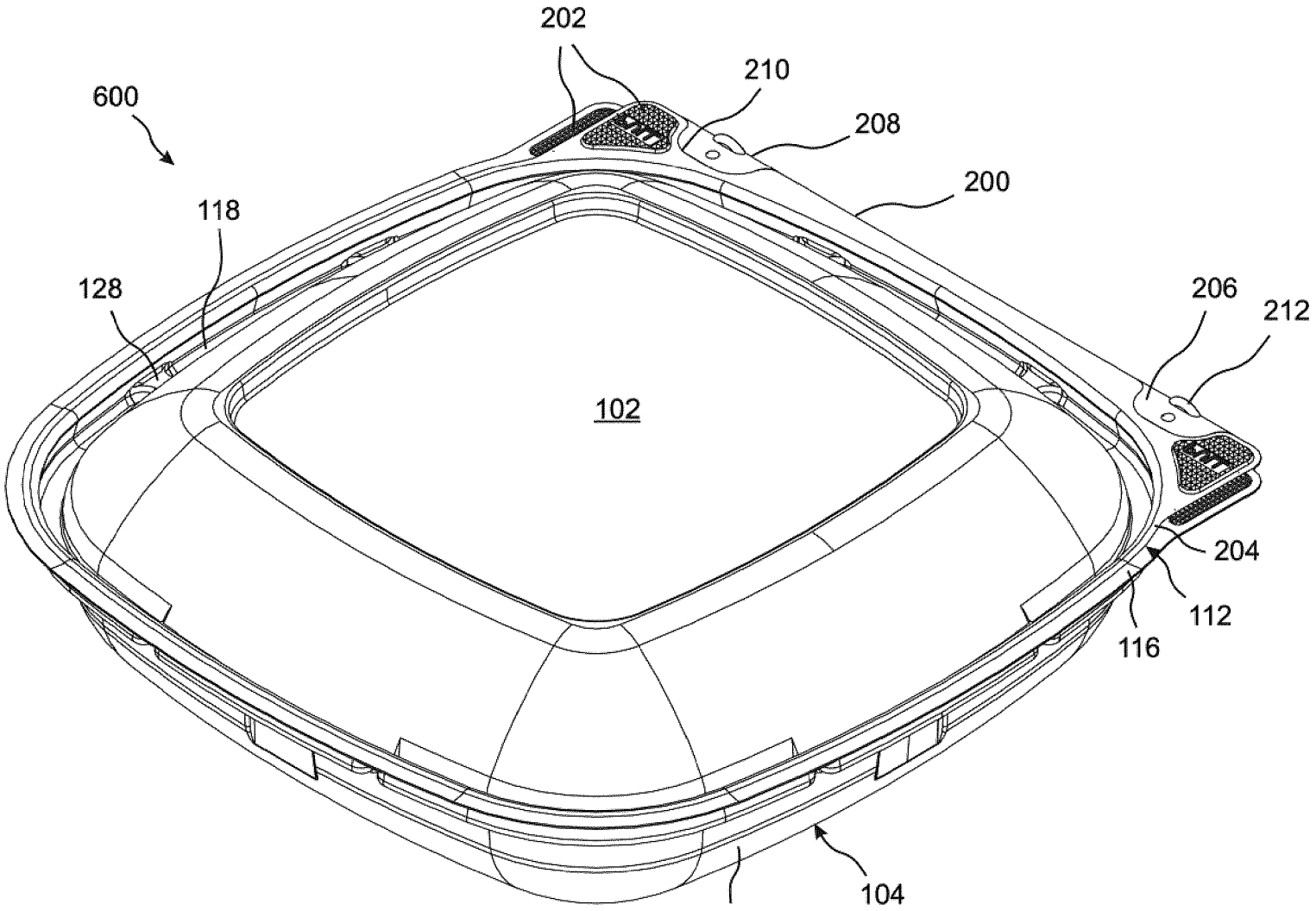
FIG. 6B is a perspective view of the embodiment of FIG. 6A, shown after the container has been filled and closed.
Figure 6C:
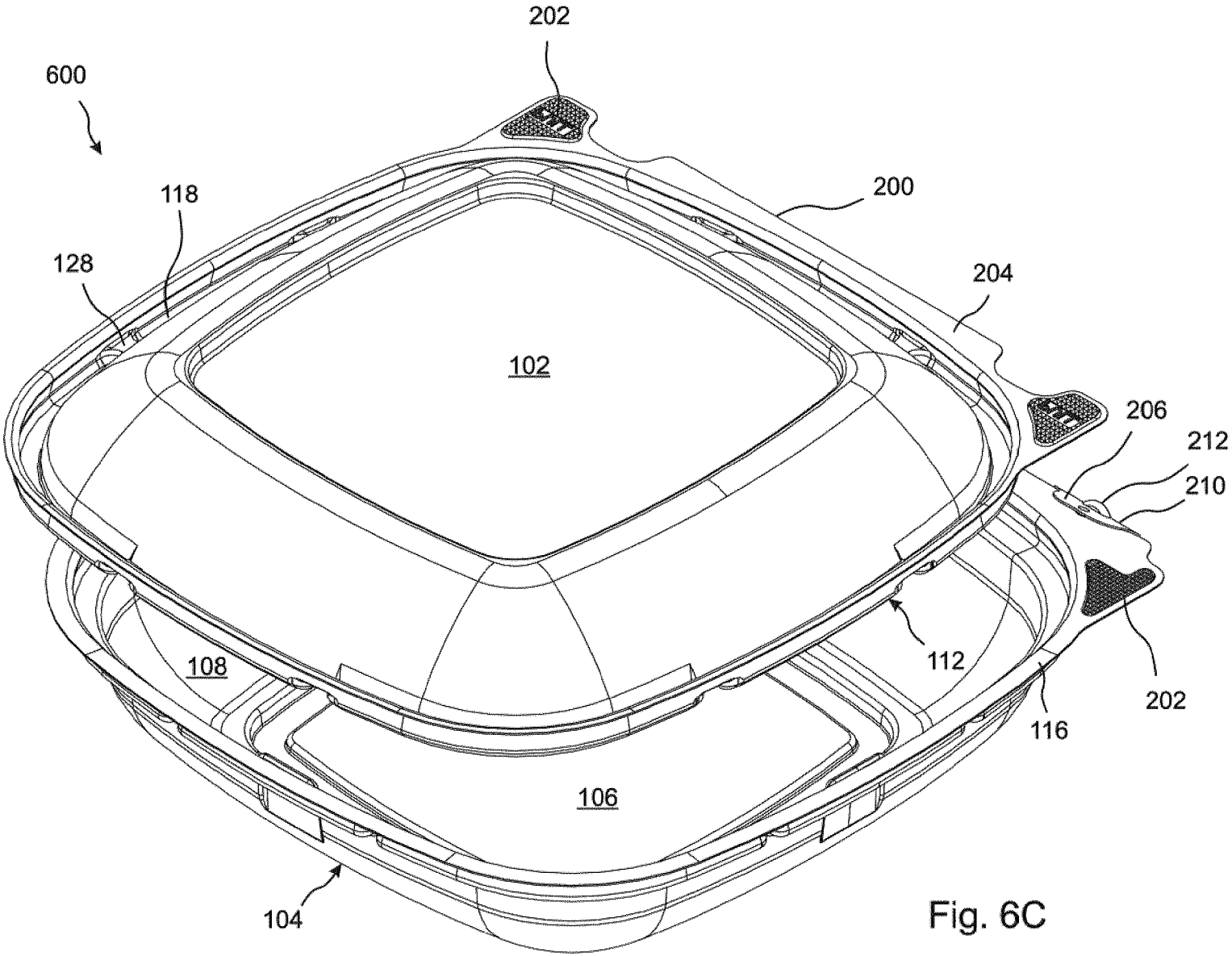
FIG. 6C is a perspective view of the embodiment of FIG. 6A, shown after it has been opened and emptied.
Figure 6D:
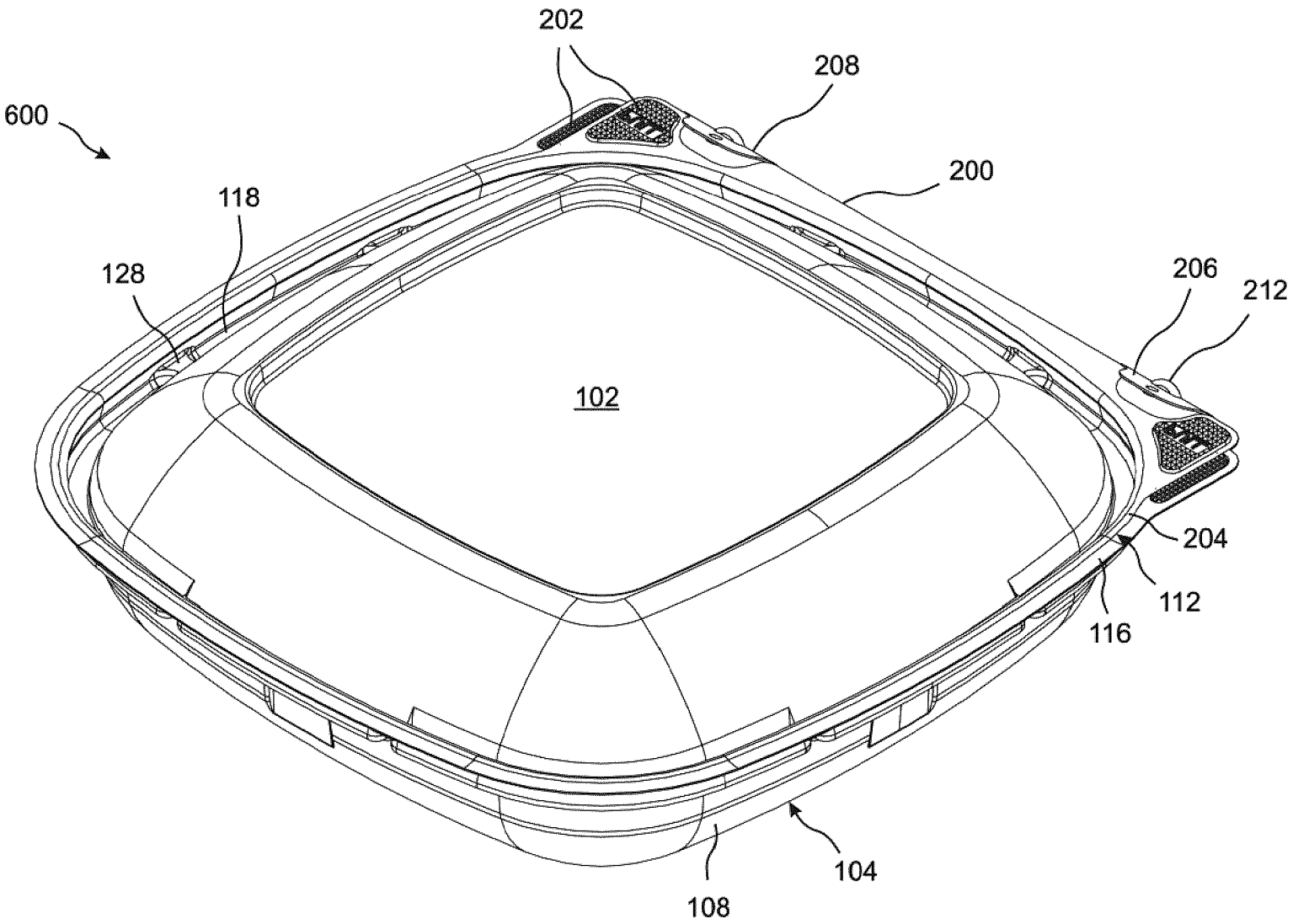
FIG. 6D is a perspective view of the embodiment of FIG. 6A, shown after it has been re-closed.

FIG. 6A presents a perspective view of the container 600 before it has been filled and closed. FIG. 6B presents a perspective view of the container 600 of FIG. 6A after it has been filled and closed. FIG. 6C is a perspective view of the container 600 of FIGS. 6A and 6B after it has been opened and emptied. And FIG. 6D is a perspective view of the container 600 after it has been re-closed. As in the other described embodiments, the attachment tabs 206 are lifted away from the plane of the lid flange 204 by the pucker features 212 when the container 600 is opened.

Figure 7A:
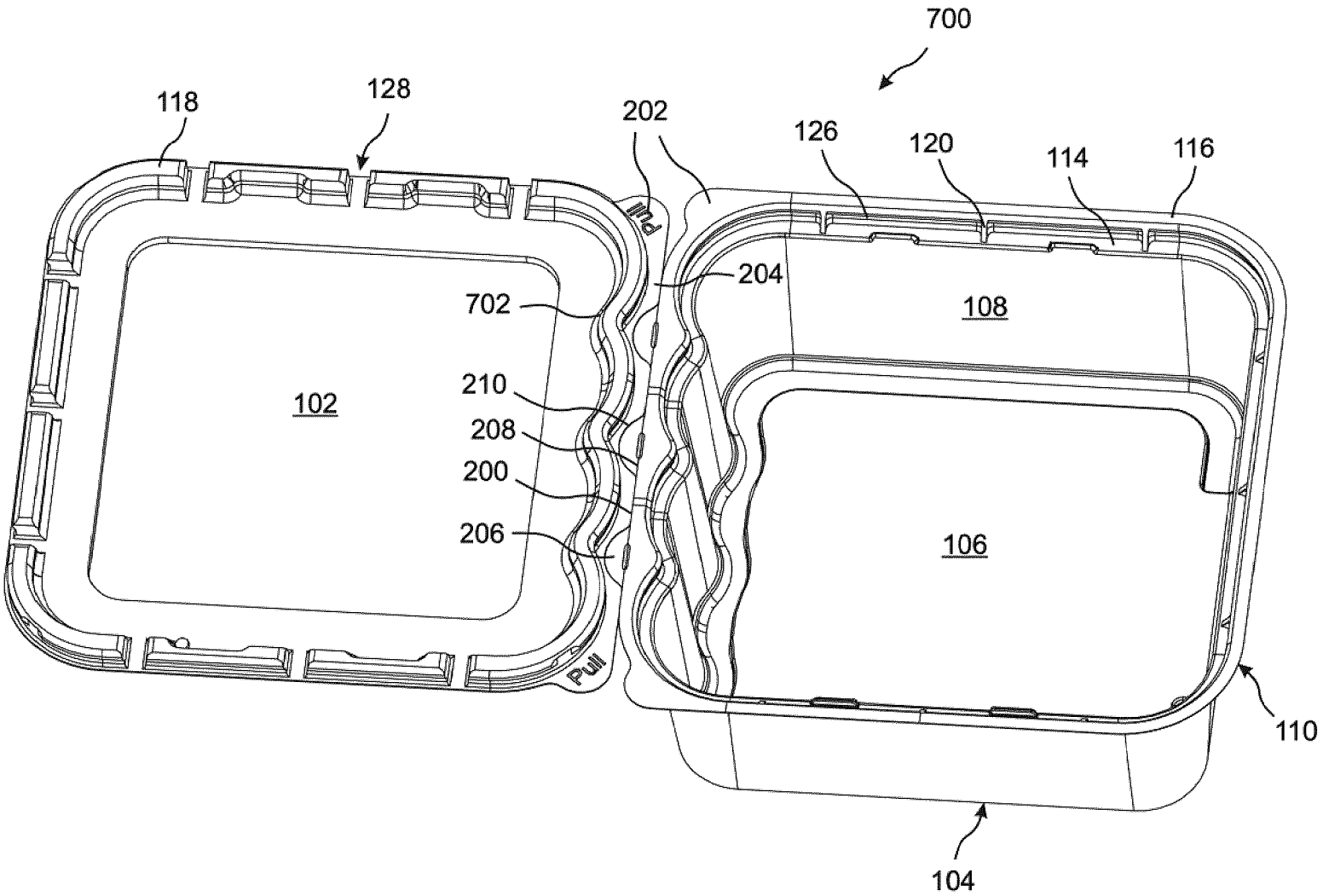
FIG. 7A is a perspective view of an embodiment where in the lid protruding features are offset inward from the attachment tabs but proximal the hinge edge of the container between the attachment tabs, the embodiment being shown before initial filling of the container.
Figure 7B:
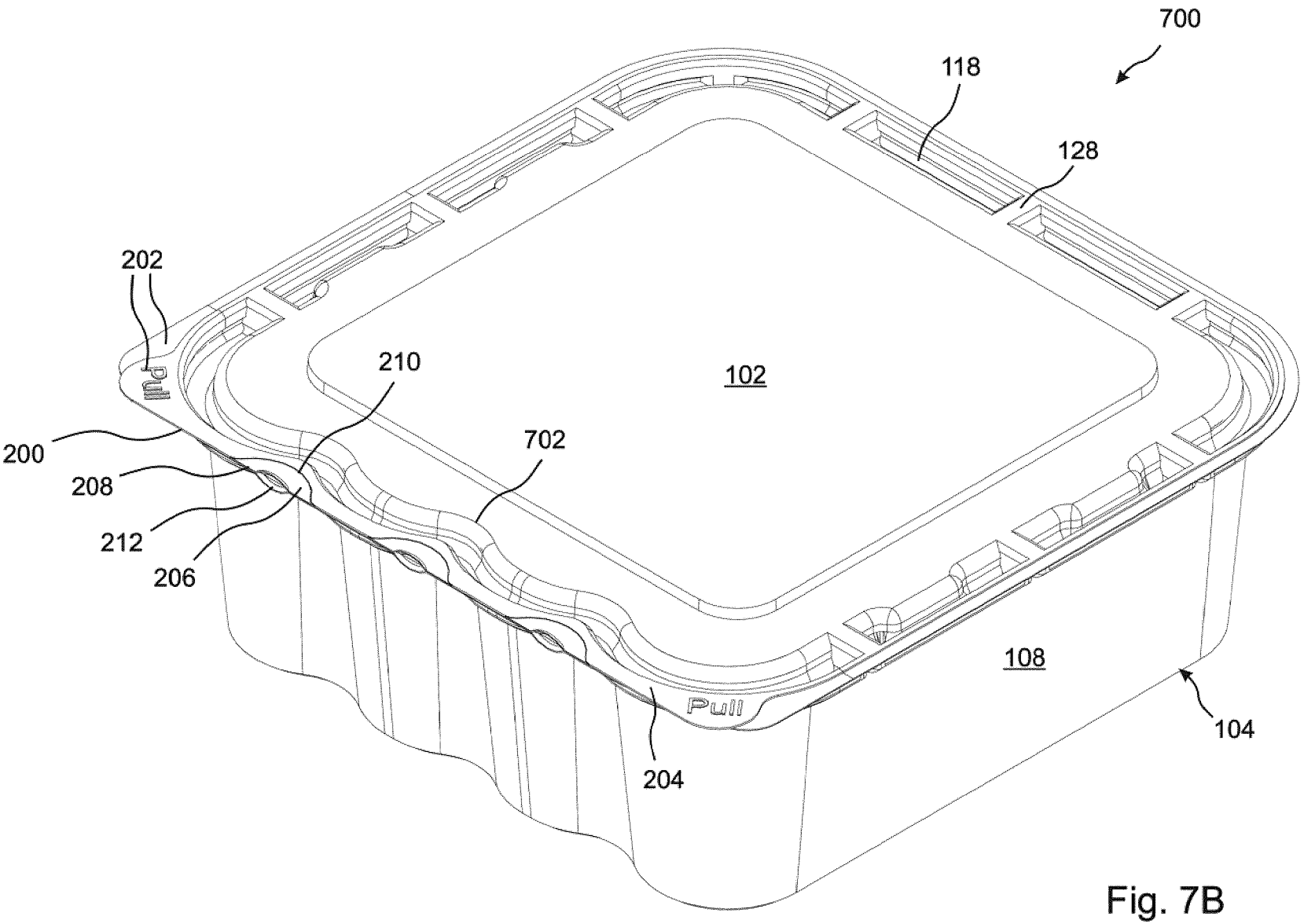
FIG. 7B is a perspective view of the embodiment of FIG. 7A, shown after the container has been filled and closed.
Figure 7C:
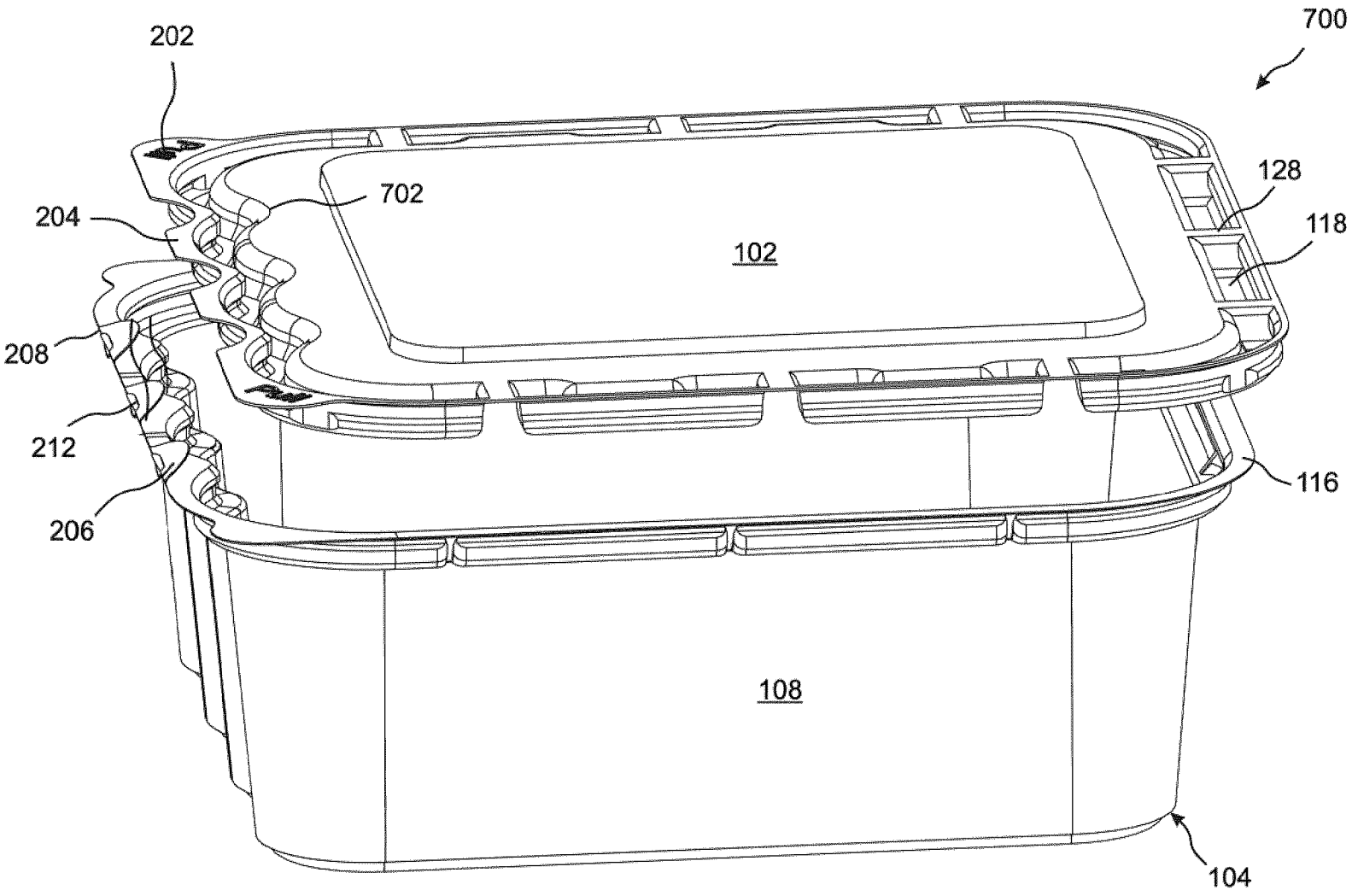
FIG. 7C is a perspective view of the embodiment of FIG. 7A, shown after it has been opened and emptied.
Figure 7D:
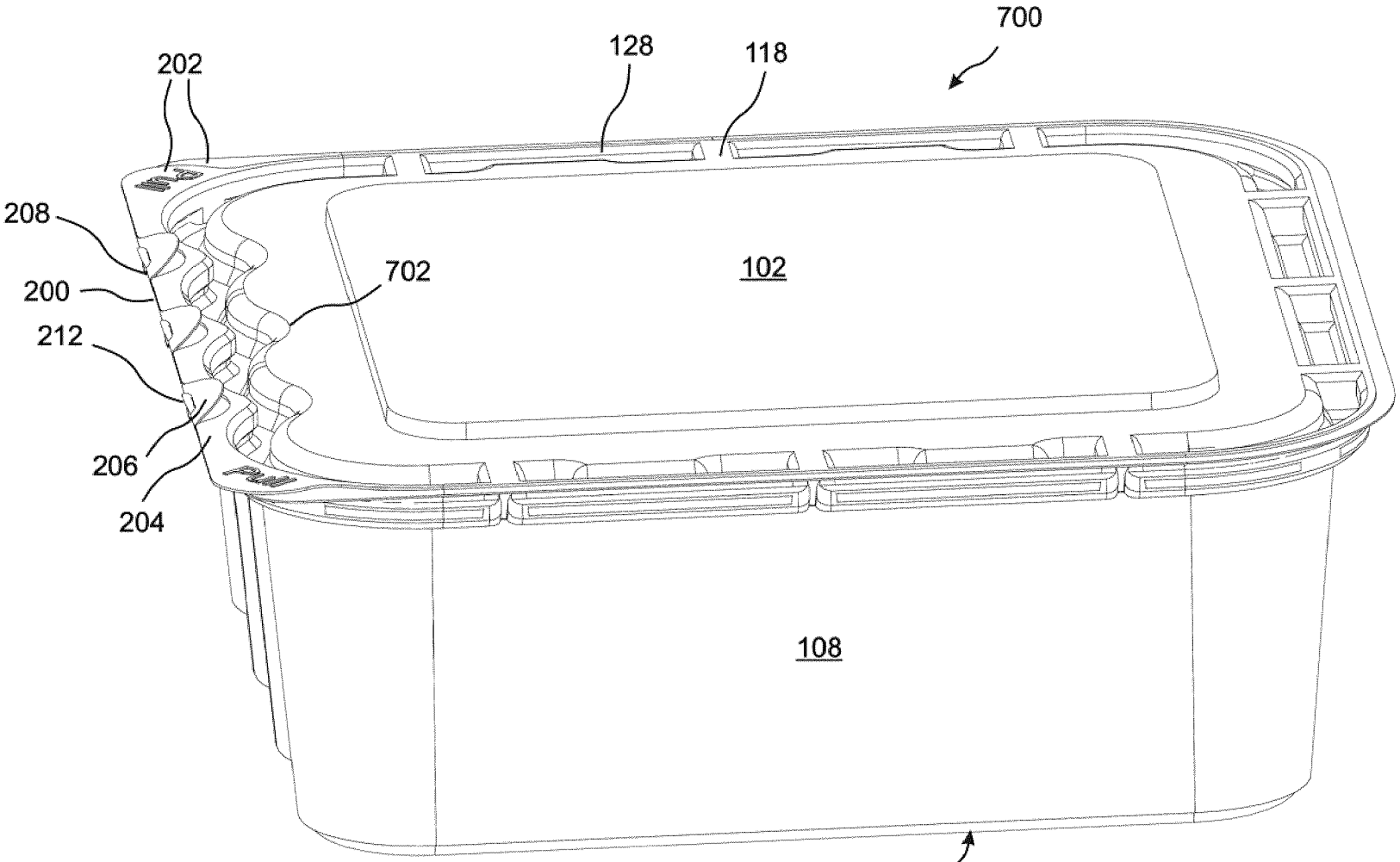
FIG. 7D is a perspective view of the embodiment of FIG. 7A, shown after it has been re-closed.
Figure 7E:
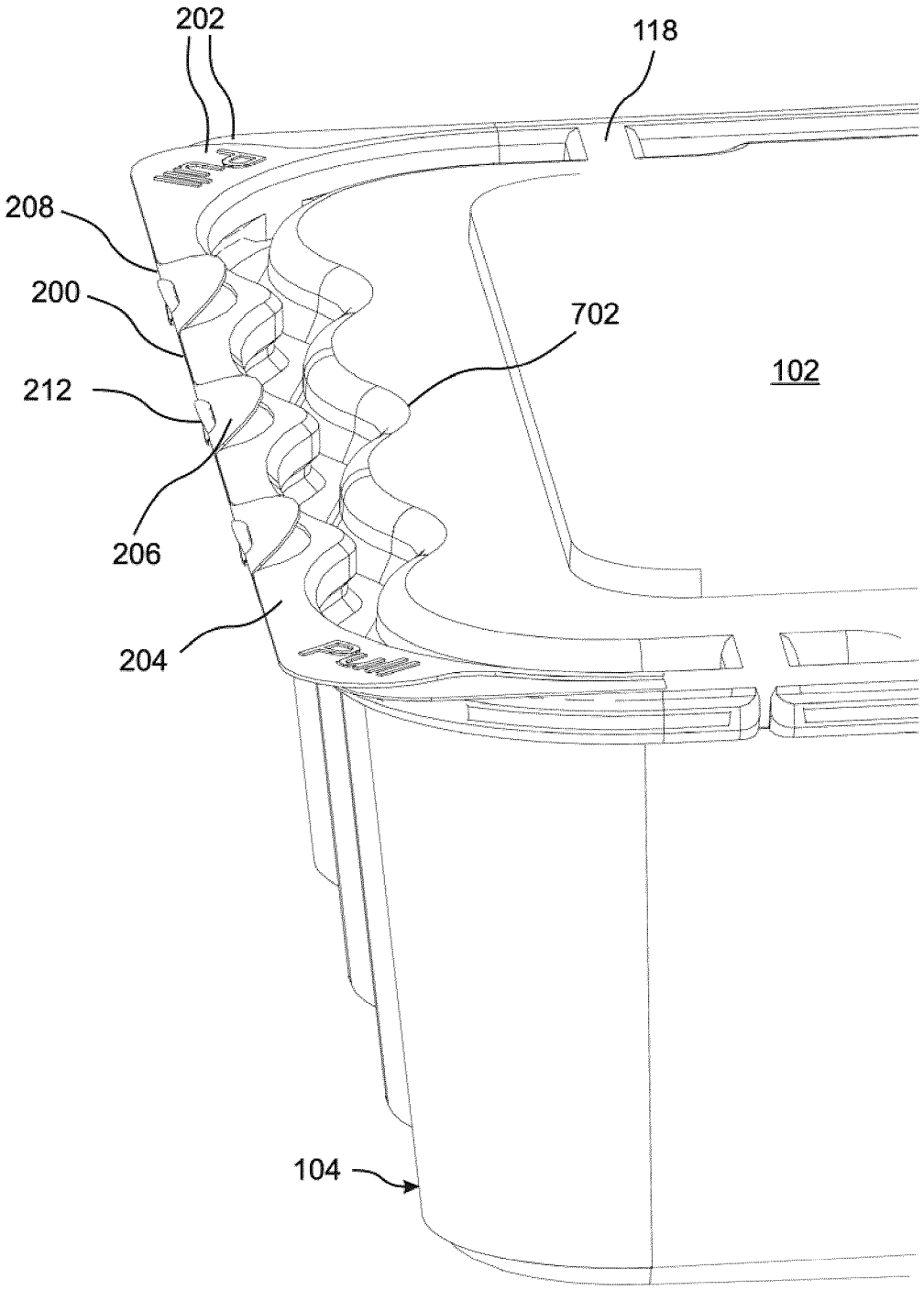
FIG. 7E is a close-up view of the hinge side of the embodiment of FIG. 7D.

FIG. 7A presents a perspective view of the container 700 before it has been filled and closed. FIG. 7B presents a perspective view of the container 700 of FIG. 7A after it has been filled and closed. FIG. 7C is a perspective view of the container 700 of FIGS. 7A and 7B after it has been opened and emptied. As in the other described embodiments, the attachment tabs 206 are lifted away from the plane of the lid flange 204 by the pucker features 212 when the container 700 is opened. FIG. 7D is a perspective view of the container 600 after it has been re-closed. And FIG. 7E is a close-up view of the living hinge side of the container 700 of FIG. 7D.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

Although the present application is shown in a limited number of forms, the scope of the invention is not limited to just these forms, but is amenable to various changes and modifications without departing from the spirit thereof. The disclosure presented herein does not explicitly disclose all possible combinations of features that fall within the scope of the invention. The features disclosed herein for the various embodiments can generally be interchanged and combined into any combinations that are not self-contradictory without departing from the scope of the invention. In particular, the limitations presented in dependent claims below can be combined with their corresponding independent claims in any number and in any order without departing from the scope of this disclosure, unless the dependent claims are logically incompatible with each other.

We claim:

1. A tamper evident container, comprising:

a base having a substantially horizontal bottom joined at a perimeter thereof to a lower edge of at least one substantially vertical base wall, the base comprising a substantially horizontal base flange extending outwardly from an upper rim of the base;

a lid that can be installed onto the base such that a seal is formed between the lid and the base, the lid being surrounded by a lid flange;

a pull tab in the lid flange, the pull tab proximal to a living hinge side of an upper edge of the base, the pull tab facilitating grasping of the lid and the base to pull the lid and the base apart and breaking a frangible attachment therebetween; and at least one attachment tab attached by the living hinge to the living hinge side of an upper edge of the base, the at least one attachment tab being attached to the same living hinge side of the upper edge of the base, the at least one attachment tab being incorporated into and substantially co-planar with the lid flange, and being bounded by frangible tab boundaries that permit the at least one attachment tab to be broken free of the lid, thereby freeing the lid from the base;

the at least one attachment tab being coordinate with a corresponding pucker element, such that when the at least one attachment tab is broken free from the lid and the lid is subsequently re-installed on the base, the at least one attachment tab is caused by the pucker elements to extend upward away from the lid flange.

2. The container of claim 1, wherein the at least one base wall includes a substantially horizontal shelf extending outward, the substantially horizontal shelf terminating in a substantially vertical, upwardly extending rim wall, said rim wall terminating in the outwardly extending, substantially horizontal base flange.

3. The container of claim 2, wherein the lid comprises a plurality of protruding lid features that extend downward from the lid, wherein when the lid is installed on the base the protruding lid features extend downward along the rim wall of the base toward the substantially horizontal shelf of the base.

4. A tamper evident container, comprising:

a base having a substantially horizontal bottom joined at a perimeter thereof to a lower edge of at least one substantially vertical base wall, the base comprising a substantially horizontal base flange extending outwardly from an upper rim of the base;

a lid that can be installed onto the base such that a seal is formed between the lid and the base, the lid being surrounded by a lid flange; and at least one attachment tab attached by a living hinge to a living hinge side of an upper edge of the base, the at least one attachment tab being attached to the same living hinge side of the upper edge of the base, the at least one attachment tab being incorporated into and substantially co-planar with the lid flange, and being bounded by frangible tab boundaries that permit the at least one attachment tab to be broken free of the lid, thereby freeing the lid from the base;

the at least one attachment tab being coordinate with a corresponding pucker element, such that when the at least one attachment tab is broken free from the lid and the lid is subsequently re-installed on the base, the at least one attachment tab is caused by the pucker elements to extend upward away from the lid flange;

wherein the at least one substantially vertical base wall includes a substantially horizontal shelf extending outward, the substantially horizontal shelf terminating in a substantially vertical, upwardly extending rim wall, said rim wall terminating in the outwardly extending, substantially horizontal base flange;

wherein the lid comprises a plurality of protruding lid features that extend downward from the lid, wherein when the lid is installed on the base the protruding lid features extend downward along the rim wall of the base toward the substantially horizontal shelf of the base; and wherein gaps between the protruding lid features are provided in the regions of the at least one attachment tab so that the protruding lid features do not overlap the at least one attachment tab, and so that upon reattachment of the lid to the base, the container is ventilated due to openings in the lid resulting from the breaking free of the at least one attachment tab from the lid.

5. The container of claim 3, wherein in regions proximate the at least one attachment tab the protruding lid features are located inward of the at least one attachment tab, so that the protruding lid features do not overlap the at least one attachment tab, and so that upon reattachment of the lid to the base, the container is not ventilated due to openings in the lid resulting from the breaking free of the at least one attachment tab from the lid.

6. The container of claim 5, wherein the protruding lid features are located inward from the at least one attachment tab and are substantially parallel with the hinge edge of the base flange.

7. The container of claim 5, wherein the protruding lid features are proximate the hinge edge of the base flange in regions between the at least one attachment tab, and are offset inward from the hinge edge of the base flange in regions proximate the at least one attachment tab, such that the protruding lid features do not overlap the at least one attachment tab.

* * * * *